US011655996B2

(12) United States Patent
Kazimirovich et al.

(10) Patent No.: US 11,655,996 B2
(45) Date of Patent: May 23, 2023

(54) AIR TO AIR HEAT PUMP WITH HEAT RECOVERY FUNCTION AND EXHAUST AIR HUMIDITY FOR HEATING VENTILATION AND AIR CONDITIONING SYSTEMS

(71) Applicants: Lubnevskiy Konstantin Kazimirovich, Hallandale Beach, FL (US); Pesterev Yuri Georgievich, Moscow (RU)

(72) Inventors: Lubnevskiy Konstantin Kazimirovich, Hallandale Beach, FL (US); Pesterev Yuri Georgievich, Moscow (RU)

( * ) Notice: Subject to any disclaimer, the term of this patent is extended or adjusted under 35 U.S.C. 154(b) by 105 days.

(21) Appl. No.: 17/336,851

(22) Filed: Jun. 2, 2021

(65) Prior Publication Data

US 2022/0390126 A1 Dec. 8, 2022

(51) Int. Cl.

| | |
|---|---|
| ***F24F 12/00*** | (2006.01) |
| ***F24F 3/00*** | (2006.01) |
| ***F24F 3/14*** | (2006.01) |
| ***F24F 13/02*** | (2006.01) |
| ***F24D 15/02*** | (2006.01) |

(52) U.S. Cl.

CPC ..... *F24F 12/003* (2013.01); *F24F 3/001* (2013.01); *F24F 3/1405* (2013.01); *F24F 13/0263* (2013.01); *F24D 15/02* (2013.01); *F24F 2221/34* (2013.01)

(58) Field of Classification Search

CPC .. F24F 3/001; F24F 6/04; F24F 12/003; F24F 2013/225

See application file for complete search history.

(56) References Cited

U.S. PATENT DOCUMENTS

| | | | | | |
|---|---|---|---|---|---|
| 2,092,630 | A * | 9/1937 | Bailey | F24F 6/04 | 261/106 |
| 3,128,610 | A * | 4/1964 | Moore | F24F 1/0323 | 165/56 |
| 3,171,401 | A * | 3/1965 | McDuffee | F24F 6/04 | 261/DIG. 15 |
| 3,416,564 | A * | 12/1968 | Peters | F24F 6/04 | 137/844 |
| 3,464,400 | A * | 9/1969 | Wellman | F24F 6/04 | 236/44 R |
| 4,655,278 | A * | 4/1987 | Seguin | F24F 3/001 | 62/412 |
| 4,827,733 | A * | 5/1989 | Dinh | F24F 6/02 | 62/196.3 |

(Continued)

*Primary Examiner* — Christopher R Zerphey
(74) *Attorney, Agent, or Firm* — Mark Terry

(57) ABSTRACT

An air-to-air heat pump system for a heating, ventilation and air conditioning (HVAC) system for a building includes a thermally insulated cool channel for pumping external air into the building, the cool channel having a volume for mixing external air with exhaust air of the building, a warm channel for pumping internal air, the warm channel including a cellular humidifier that restores humidity to internal air, heat pump coils located in the cool channel and the warm channel, the heat pump coils configured for transferring thermal energy from the cold channel to the warm channel, a first fan located in the cool channel and a second fan located in the warm channel, wherein the first and second fans are configured for moving air within a channel, all of the foregoing provided in a monoblock or Split structure located inside, or partially inside, a thermal circuit of the building.

10 Claims, 3 Drawing Sheets

(56) References Cited

U.S. PATENT DOCUMENTS

| | | | | |
|---|---|---|---|---|
| 5,193,610 | A * | 3/1993 | Morissette | F24F 12/006 165/909 |
| 5,257,736 | A * | 11/1993 | Roy | F24F 11/0001 236/44 R |
| 6,336,338 | B1 * | 1/2002 | Koren | F24F 1/027 62/262 |
| 6,347,527 | B1 * | 2/2002 | Bailey | F24F 3/001 165/59 |
| 9,791,165 | B2 * | 10/2017 | McKay | F24F 6/02 |
| 9,797,648 | B2 * | 10/2017 | Ishikawa | F24F 11/30 |
| 11,486,595 | B2 * | 11/2022 | Gustavsson | F24F 12/003 |
| 2004/0074251 | A1 * | 4/2004 | Shahbaz | F24F 13/222 62/332 |
| 2009/0079098 | A1 * | 3/2009 | Ezra | F24F 3/14 261/78.2 |
| 2021/0108805 | A1 * | 4/2021 | Imaizumi | F24F 13/20 |

* cited by examiner

AIR TO AIR HEAT PUMP WITH HEAT RECOVERY FUNCTION AND EXHAUST AIR HUMIDITY FOR HEATING VENTILATION AND AIR CONDITIONING SYSTEMS

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to the field of heating, ventilation, and air conditioning (HVAC) systems and, more specifically, to servicing HVAC systems using telecommunications networks.

BACKGROUND

Heating, ventilation, and air conditioning (HVAC) systems are ubiquitous in modern society and comprise a worldwide industry. Heating, ventilation, and air conditioning is the technology of indoor environmental comfort. The of HVAC is to provide thermal comfort and acceptable indoor air quality. HVAC is also an important part of residential structures such as single-family homes, apartment buildings, hotels, and senior living facilities, medium to large industrial and office buildings such as skyscrapers and hospitals, and in marine environments, where safe and healthy building conditions are regulated with respect to temperature and humidity, using fresh air from outdoors. Ventilating or ventilation is the process of exchanging or replacing air in any space to provide high indoor air quality which involves temperature control, humidity, oxygen replenishment, and removal of carbon dioxide and other gases, odors, smoke, dust, and airborne bacteria. Ventilation introduces outside air, mixing with the interior building air, and prevents stagnation of the interior air.

One of the problems associated with conventional HVAC systems is their inefficiency. The inefficiency lies in the fact that they do not solve their task of providing comprehensive high-quality indoor air—this is to maintain the necessary temperature, humidity and replace the exhaust air with fresh air. And these three tasks are solved independently of each other that leads to the loss or inefficient use of energy. This can be costly and financially damaging to the operator of the HVAC system. Another problem associated with conventional HVAC systems involves heat loss. Heat is often lost in several parts of the HVAC process, such as heated exhaust air leaving a heated building to a cold exterior. This can be wasteful and inefficient. Yet another problem associated with conventional HVAC systems involves humidity. The process of heating a building and ventilation (replacement of exhaust air with fresh air) often results in the internal air becoming dry and lacking in humidity. This can be uncomfortable and even harmful to health of persons within the building.

Therefore, a need exists for improvements over the prior art, and more particularly for methods and systems that increase the efficiency of HVAC system by addressing issues of efficiency, heat loss and humidity.

SUMMARY

A method and system that improves the efficiency of an HVAC system is provided. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, an air-to-air heat pump system for a heating, ventilation and air conditioning (HVAC) system for a building includes a thermally insulated cool channel for pumping external air into the building, the cool channel having a volume for mixing external air with exhaust air of the building, a warm channel for pumping internal air, the warm channel including a cellular humidifier that restores humidity to internal air, heat pump coils located in the cool channel and the warm channel, the heat pump coils configured for transferring thermal energy from the cold channel to the warm channel, a first fan located in the cool channel and a second fan located in the warm channel, wherein the first and second fans are configured for moving air within a channel, all of the foregoing provided in a monoblock or split structure located inside, or partially inside, a thermal circuit of the building.

BRIEF DESCRIPTION OF THE DRAWINGS

The accompanying drawings, which are incorporated in and constitute a part of this disclosure, illustrate various example embodiments. In the drawings.

DETAILED DESCRIPTION

Figure 1:
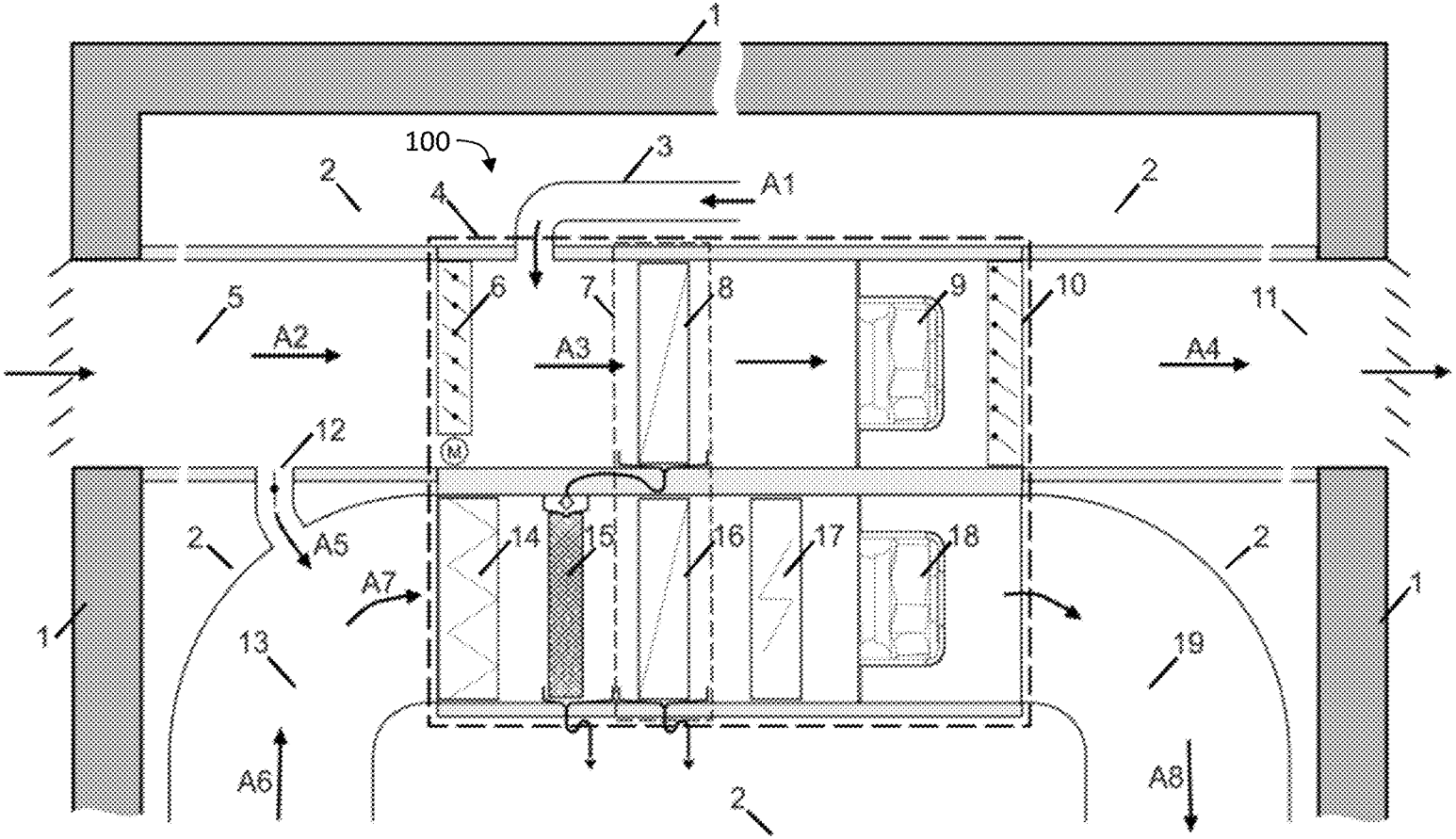
FIG. 1 is a diagram of air-to-air heat pump system for a heating, ventilation, and air conditioning (HVAC) system for a building, wherein the air-to-air heat pump system in the form of a monoblock is completely located within the building, according to an example embodiment.

The following detailed description refers to the accompanying drawings. Wherever possible, the same reference numbers are used in the drawings and the following description to refer to the same or similar elements. While embodiments herein may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed embodiments. Instead, the proper scope of the claimed embodiments is defined by the appended claims.

The methods and systems of the claimed embodiments reduce energy inefficiencies associated with conventional HVAC systems, thereby increasing efficiency, and decreasing energy loss and operating costs. The claimed embodiments further reduce heat loss associated with the replacement of exhaust air with fresh in conventional HVAC systems, thereby cutting down on energy expenditure and increasing productivity. The claimed embodiments further address the humidity problems associated with conventional HVAC systems in the cold season-returning humidity in exhaust air back to the house, thereby increasing comfort for persons within the building.

The methods and systems of the claimed embodiments further improve over the prior art by eliminating the need for an expensive "winter" kit necessary to ensure the operation of a conventional heat pump at low ambient temperatures, since in the claimed embodiments the coil of the evaporator is always heated by the thermal energy of the exhaust air before applying cold external air to it, which ensures a stable start of boiling of the refrigerant in it.

The methods and systems of the claimed embodiments further improve over the prior art by providing a coefficient of performance higher than said coefficient of a conventional split-system heat pump with a similar compressor system, operating at an equally low outdoor temperature, since the air supplied to the evaporator in the claimed embodiments will always have a higher temperature due to the mixing with warm exhaust air. In this case, the thermal energy of the exhaust air is taken by the coil of evaporator together with the low-potential thermal energy of the external air to heat the internal air of the building. Consequently, with the use of the claimed embodiments, there is no need to purchase a special supply and exhaust system with the return of the heat energy of the exhaust air and its humidity). Further, with the use of the claimed embodiments, the minimum compressor reverse time during defrosting, or defrosting without reverse, allows the user to eliminate the discomfort of traditional heat pumps for residents associated with heat extraction from the premises. Additionally, with the use of the claimed embodiments, there is no need to prepare and supply water for operating the humidifier, since it is supplied with waste meltwater obtained by defrosting the evaporator, which meltwater does not contain-salts and is ideal for a humidifier.

The claimed system will now be described with reference to FIG. 1, which is a diagram of air-to-air heat pump system 100 for a heating, ventilation, and air conditioning (HVAC) system for a building, wherein the air-to-air heat pump system is completely located within the building, according to an example embodiment. The thermal circuit of the building 1 refers to the path or paths of heat transfer that occurs in a building due to its HVAC system and the ambient environment. The purpose of the HVAC system and the claimed embodiments is to provide a comfortable environment for the internal space 2 of the building.

A heat pump is defined as a device used to warm or cool a building by transferring thermal energy from a cooler space to a warmer space using the refrigeration cycle, being the opposite direction in which heat transfer would take place without the application of external power. That is, a heat pump transfers thermal energy from the interior of the building to the exterior using the refrigeration cycle in summer and transfers thermal energy from the exterior of the building to the interior using the refrigeration cycle in winter. A heat pump can be used in winter to move heat between two heat exchangers, one outside the building which is fitted with fins through which air is forced using a fan and the other which heats the air inside the building directly which is then circulated around the building which releases the heat to the building. A heat pump can be used in summer in a cooling mode where it extracts heat via an internal heat exchanger and ejects it into the ambient air using an external heat exchanger.

Path A2 shows the flow of cold air from the outside environment into the air-to-air heat pump system 100 via heat-insulated duct 5, otherwise known as a cold channel, that brings cold outside air into the system 100. Path A4 shows the flow of air from the air-to-air heat pump system 100 to the outside environment, via heat-insulated air duct 11, also part of the cold channel.

The air duct 3 is configured to remove air, now known as exhaust air, from the internal space of the building to the heat pump casing or prefabricated structure 4 (described more fully below) via path A1. The path A6 shows the flow of air returning from the interior space of the building (otherwise known as return air) to the heat pump casing or prefabricated structure 4, via return air duct collector 13, otherwise known as the warm channel Path A8 shows the flow of air from the heat pump casing or prefabricated structure 4 into the interior space of the building, via supply air duct collector 19, also part of the warm channel.

FIG. 1 shows that the heat pump casing or prefabricated structure 4, which houses the main components of the air-to-air heat pump system 100. The heat pump casing or prefabricated structure 4 may be assembled from separate blocks and modules. The heat pump casing or prefabricated structure 4 may alternatively comprise a monoblock structure comprising one integrated blocklike structure that houses all of the components noted within the dotted lines of item 4 of FIG. 1. After entrance of air via path A2, said air enters the heat pump casing or prefabricated structure 4 via an inlet valve 6, which may comprise a louver type inlet valve with an electric drive. Path A3 shows the mixture of two air flows A1 and A2, which include ambient air and exhaust air of the building.

Figure 2:
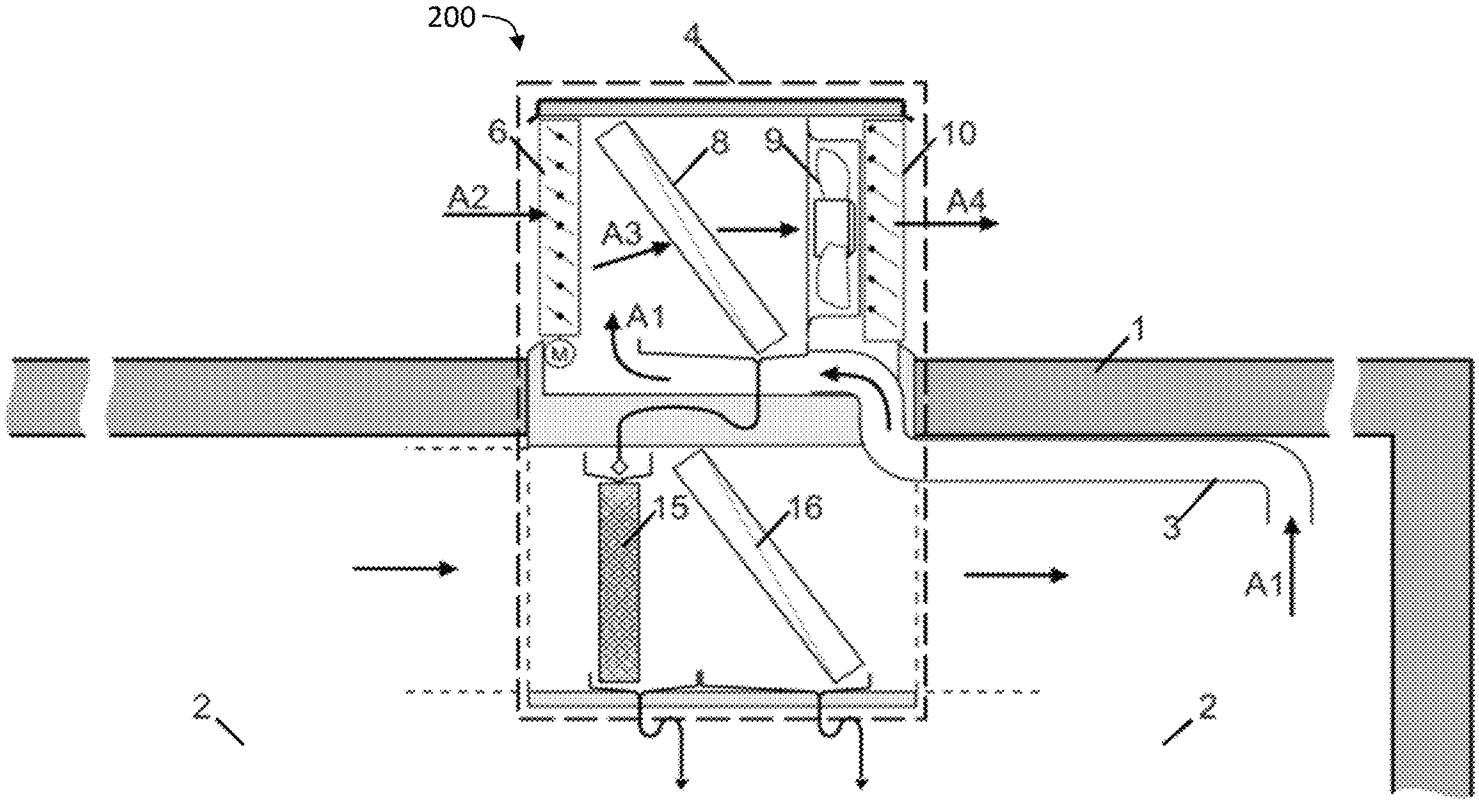
FIG. 2 is a diagram of air-to-air heat-pump system for an HVAC system for a building, wherein the air-to-air heat pump system is in the form of a monoblock partially located within the building, according to an example embodiment.
Figure 3:
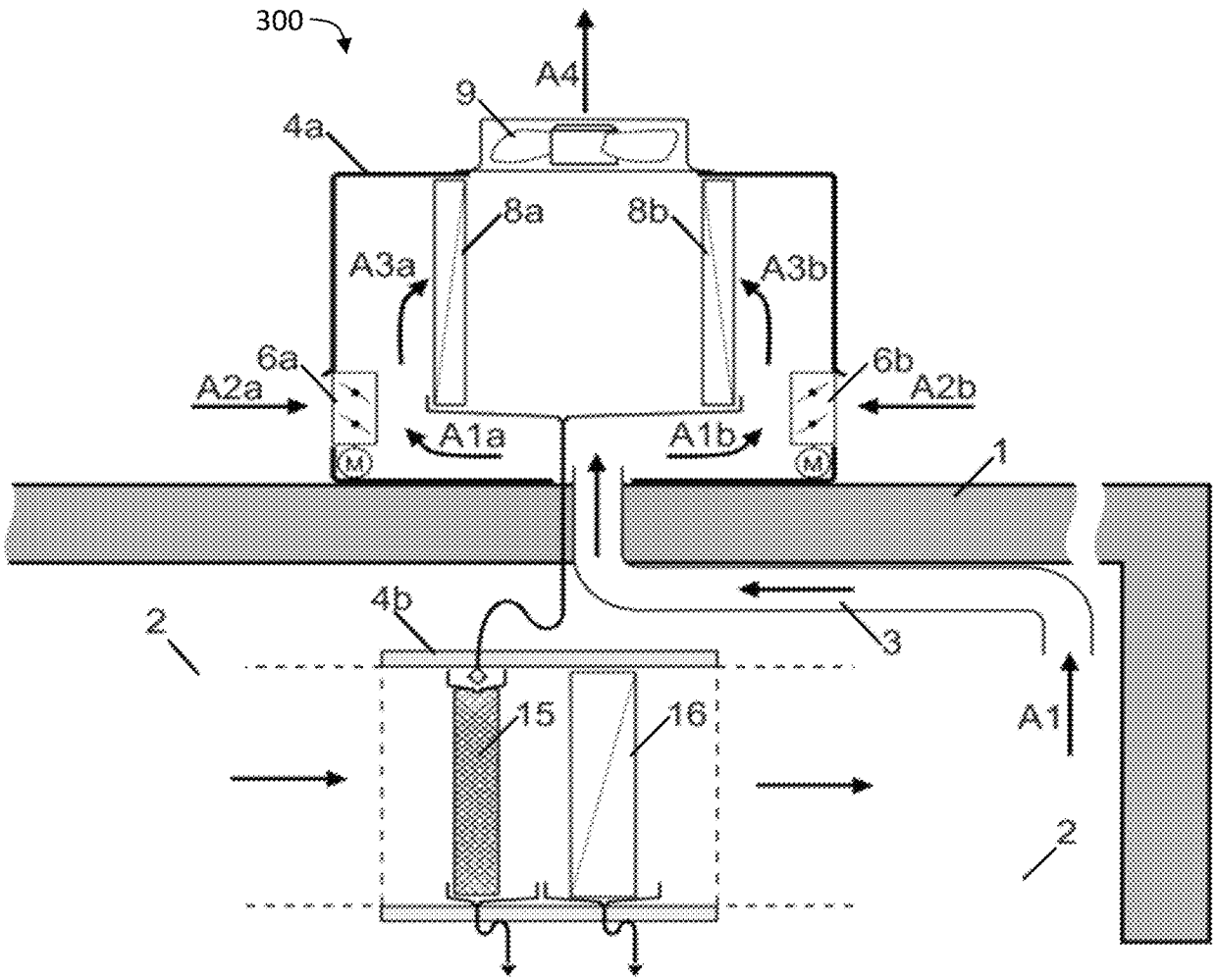
FIG. 3 is a diagram of air-to-air heat pump system for an HVAC system for a building, wherein the air-to-air heat-pump system in the form of a Split System is structurally divided and located partially inside and partially outside the building, according to an example embodiment.

Heat pump 7 includes a compressor and other elements of the gas-hydraulic heat pump circuit, which can be located both inside the heat circuit of the building (FIG. 1 and FIG. 2), and in the external unit 4*a* (FIG. 3). Heat pump coil 8 is located in path A3. Said heat pump coil may be an evaporator in heating mode and may include a tray and a hose for removing meltwater. A fan 9 moves air through the cold channel from path A3 to path A4, and a gravity type air outlet valve 10 may be located downstream of the fan 9.

Air duct 12 is configured for supplying air from path A2 to path A5, and eventually to path A7, which includes a mixture of return air from the interior of the building with supply air from the outside environment. A valve in air duct 12 may be configured to regulate the amount of air entering via air duct 12. The air in path A7 moves through an air filter 14, and subsequently a cellular humidifier 15, which may be a channel or bypass type humidifier, and which may include a filter, storage tank, tray, and drainage hose. Next, the air in path A7 moves around heat pump coil 16 of heat pump 7, which may be a condenser in heating mode, and which may include a pan and drain hose. Next, the air in path A7 moves around a backup electric heater 17. A fan 18 moves air through the warm channel from path A6 to path A8.

As described above in the claimed embodiments, the air-to-air heat pump system 100 recuperates heat and moisture from exhaust air of the heated building, resulting in the reduction of energy consumption when heating the building; while maintaining air humidity in heated rooms more efficiently than conventional HVAC systems in conditions where the ambient air has low temperature and low humidity. As discussed above, FIG. 1 shows heat pump casing or prefabricated structure 4 in the form of a monoblock located inside the thermal circuit of the building. In one embodiment, the monoblock may be a structure assembled from separate blocks and modules.

The method of the claimed embodiments are described herein with reference to FIG. 1. The flow of outside atmospheric air follows path A2 as it enters the heat circuit of the building 1 through the heat-insulated air duct 5 of the cold channel and the open valve 6 into the volume in front of the heat pump coil 8 of the heat pump 7, which may be an evaporator in heating mode. In this volume, the flow of cold and relatively dry outside atmospheric air is mixed with the flow of warm and moist exhaust air of the building entering on path A1 via air duct 3. Mixing the air flows from path A2 and path A1 forms a new air flow on path A3. Said mixture results in heating and the dry outside atmospheric air of path A2 being humidified, as the moist exhaust air of the building entering on path A1 adds humidity and transfers thermal energy to said air, thereby increasing its temperature. The air flowing on path A3 flows through the heat pump coil 8 of the heat pump 7, which takes thermal energy from said air, thereby lowering its temperature.

After the air flowing on path A3 flows through the heat pump coil 8 of the heat pump 7, said air follows path A4 and is removed into the environment by means of a fan 9 through the gravity valve 10 and the air duct 11. The heat energy from the heat pump coil 8 is pumped by the heat pump 7 to the heat pump coil 16 of the "warm" channel (the condenser in the heating mode). This heat energy is transferred by the heat pump coil 16 to the path A7. The path A7 is formed by a flow of return air from the premises via path A6, entering the housing of the heat pump casing or prefabricated structure 4 from the return air duct collector 13, to which is added fresh outdoor air from path A5 from the supply air duct 12. Before entering the inlet of the heat pump coil 16, the air of path A7 is cleaned of mechanical impurities in the filter 14 and humidified in the honeycomb or cellular humidifier 15. The heated air from the heat pump coil 16 is additionally reheated, if necessary, by a backup electric heater 17 and is pumped by a fan 18 into the supply collector 19 via path A8, which is further distributed throughout the interior of the building.

The cooled and used air from the interior of the building is returned from the building to the heat pump casing or prefabricated structure 4 via the return collector 13 (via path A6). However, some of the air from the interior of the building (such as from the bathrooms and technical rooms) enters the air duct 3 for exhaust air removal via path A1. The air on path A1 is mixed with the flow of outdoor air in path A2, forming mixed air traveling via path A3. Likewise, the air entering duct 13 via path A6 is mixed with air entering duct 13 via path A5, forming the mixed air traveling along path A7. Thus, the air flow treatment cycle of the claimed embodiments is repeated with the constant extraction of low-potential heat energy from the outside air and recovery of the heat energy from the exhaust air using the air-to-air heat-pump system 100. At the same time, there is no need to use special equipment, such as a recuperator, in the form of a separate device for supplying fresh air and removing exhaust air.

The main advantage of the method of using the air-to-air heat-pump system 100 is that due to the higher temperature of the air in path A3 (compared to the ambient temperature of air in path A2), which was increased by mixing the warm exhaust air in path A1 with the cold outside air in path A2, the operating temperature range of the heat pump 7 increases to lower ambient temperatures compared to conventional HVAC systems. In addition, the method of using the air-to-air heat-pump system 100 simplifies the implementation of a number of energy-intensive modes of heat pumps of this type, such as the defrosting mode, which is increases energy expenditure in conventional HVAC systems. Moreover, using the air-to-air heat pump system 100, it is possible to return moisture to the interior of the building, which is typically carried away by the air in path A1 in winter, which usually leads to a critical decrease in humidity in the interior of the building due to the replacement of moist air with dry air due to ventilation. This feature of the claimed embodiments allows users to avoid the use of special humidifiers that require the supply of a large amount of water of drinking quality, which can be expensive and labor intensive.

The essence of the method of the claimed embodiments, which returns moisture to the interior of the building, is that since the plates of the heat pump coil 8 have a lower temperature than the air in path A3, the water contained in a small amount in the external air and almost all the water contained in the exhaust air begins to freeze on the surface of the plates of the heat pump coil 8. After a significant freezing of the plates, a freezing sensor coupled with said plates may be triggered, which emits an electrical signal via a wired connection. Upon said signal being detected by a central processor, the inlet valve 6 is closed, blocking the flow of cold external air via path A2, the fan speed 9 decreases and the entire flow of warm exhaust air via path A1 is directed to the partially ice-covered heat pump coil 8, ensuring its defrosting. In this case, the compressor of the heat pump 7 can be turned on to reverse to speed up the defrosting process, as it is known in the art for conventional air-to-air heat pumps, but for a much shorter time. Alternatively, the compressor of the heat pump 7 may not be turned on to reverse at all, if the ejected thermal energy of the exhaust air of in path A1 is sufficient for defrosting said plates.

The defrosting feature described above will reduce or eliminate the unpleasant feature of conventional air-to-air heat pumps associated with the cold flow of air from the supply grilles in the premises during the defrost mode, since the heat pump in this mode switches to reverse and defrosts the heat exchanger at the expense of the thermal energy of the interior of the building. I.e., the unpleasant feature of conventional air-to-air heat pumps is some lowering of interior building temperatures during defrosting. In the claimed embodiments, meltwater (as a result of the defrosting process described above) from the drain pan of the heat pump coil 8 flows through a hose with valve or gate into the storage tank of the cellular humidifier 15 in the warm channel and after filtration falls on a water pad. Meltwater, as a rule, does not contain salts. The lack of salt in the meltwater has a positive effect on the durability of the water pad and the efficiency of its operation, as salt has corrosive and clogging properties. Excess water that has passed the water pad is removed from the drain pan of humidifier 15 using a drainage hose. The air in path A7 after the filter 14 enters the water pad of the cellular humidifier 15 and carries the moisture further to the coil 16, where the air flow is heated, reheated by an electric heater 17 (if necessary) and the fan 18 is pumped into the supply collector 19 in the form of air in path A8 with high humidity.

After the defrost mode is terminated, the heat pump 7 resumes operation in the heating mode described earlier. After reaching the user-defined air temperature in the interior of the building, the control system (such as a central processor) turns off the system 100. At the same time, the fans 9 and 18 stop and the valves 6 and 10 in the cold channel are closed. All streams, including those in paths A5 and A1, stop, which results in a cost savings when the building is not in use. Alternatively, the background ventilation mode is turned on when the valve 6 of the cold channel remains closed, and all flows except the flow in path A2 are resumed at lower fan speeds 9 and 18, providing a comfortable level of freshness (movement) of air in the rooms of the interior of the building. This mode, in addition to maintaining the freshness of the air in the rooms of the interior of the building, make it easier to start the heat pump 7 with a warm coil 8 when the heating mode is resumed and the valve 6 is opened at low ambient temperatures without the use of so-called Winter Kit (a set of additional devices), necessary to eliminate the influence of processes associated with the slow start of boiling of the refrigerant in the evaporation coil 8 at a low temperature of the external air.

FIG. 2 is a diagram of air-to-air heat-pump system for an HVAC system for a building, wherein the air-to-air heat-pump system is partially located within the building, according to an example embodiment. The system 200 shown in FIG. 2 is a separate embodiment, or variant, of the system shown in FIG. 1. The system of FIG. 2 differs from the system of FIG. 1 in that the system of FIG. 2 has the cold channel located outside the thermal circuit of the building, whereas the system of FIG. 1 has the cold channel located inside the thermal circuit of the building. Additionally, the system of FIG. 2 differs from the system of FIG. 1 in that the system of FIG. 2 has some of the elements of the warm channel shown in FIG. 1 are implemented in the system of FIG. 2 in separate blocks that may not be structurally part of a monoblock structure of heat pump casing or prefabricated structure 4.

FIG. 2 further shows that the warm channel is located inside the building's heat circuit. In the embodiment of FIG. 2, the return air duct collector 13, supply air duct 12 and filter 14 are installed at the entrance of the warm channel of the heat pump casing or prefabricated structure 4 and in FIG. 2 not shown. In the embodiment of FIG. 2, the backup electric heater 17, the fan 18 and the supply air duct collector 19 are installed at the outlet of the warm channel of the heat pump casing or prefabricated structure 4 and in FIG. 2 not shown.

FIG. 3 is a diagram of air-to-air heat pump system for an HVAC system for a building, wherein the air-to-air heat pump system is located partially inside and partially outside the building, according to an example embodiment. The system 300 shown in FIG. 3 is a separate embodiment, or variant, of the system shown in FIG. 1. The system shown in FIG. 3 is a split system, which includes an external unit with evaporator coil and compressor outside the thermal circuit of the building, and includes an indoor unit, containing a humidifier and a condenser coil, located indoors or within the thermal circuit of the building.

The system of FIG. 3 differs from the system of FIG. 1 in that the system of FIG. 3 has a cold channel located outside the thermal circuit 1 of the building, in the form of an outdoor unit 4*a* with a vertical flow of air via path A4 since valve 10 is not used. The warm channel of FIG. 3 is located inside the thermal circuit 1 of the building, a part of which is made in the form of the indoor unit 4*b*. By contrast, the system of FIG. 1 has the cold channel located inside the thermal circuit of the building. Additionally, the system of FIG. 3 differs from the system of FIG. 1 in that the system of FIG. 3 has some of the elements of the warm channel are implemented in separate blocks that are not structurally part of the indoor unit 4*b*.

FIG. 3 shows that the external unit 4*a* is located outside the building's thermal circuit. FIG. 3 shows that the coil (heat exchanger) 8 can be made from four sides of the housing of external unit 4*a*, respectively, such that valves 6 are installed from all four sides. FIG. 3 shows that indoor unit 4*b* is located inside the building's thermal circuit. In the embodiment of FIG. 3, return air duct collector 13, supply air duct 12 and filter 14 are installed at the input of the indoor unit 4*b* and in FIG. 3 are not shown. In the embodiment of FIG. 3, the backup electric heater 17, the fan 18 and the supply collector 19 are installed at the output of the indoor unit 4*b* and in FIG. 3 are not shown.

The claimed embodiments are described above with reference to block diagrams and/or operational illustrations of methods, systems, and computer program products. The functions/acts noted in the blocks may occur out of the order as written above or as shown in any flowchart. For example, two blocks or steps described or shown in succession may in fact be executed substantially concurrently or the blocks or steps may sometimes be executed in the reverse order, depending upon the functionality/acts involved.

While certain claimed embodiments have been described, other embodiments may exist. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An air-to-air heat pump system for a heating, ventilation, and air conditioning (HVAC) system for a building, the air-to-air heat pump system comprising:

a) a thermally insulated cool channel for pumping external air, the cool channel having a volume for mixing external air with exhaust air of the building;

b) a warm channel for pumping internal air;

c) a first heat pump coil in the cool channel and a second heat pump coil in the warm channel, the first and second heat pump coils configured for transferring thermal energy from the cold channel to the warm channel;

d) a drain pan located under the first heat pump coil in the cool channel, the drain pan configured for catching water melted from defrosting the first heat pump coil;

e) a cellular humidifier located in the warm channel that restores humidity to the internal air, including a hose that transfers water from the drain pan of the first heat pump coil to the cellular humidifier;

f) an air inlet valve in the cool channel for regulating ingress of external air, wherein when the valve is open, external air is pumped through the cold channel, and wherein when the valve is closed, only internal air is pumped through the cold channel;

g) a first fan located in the cool channel and a second fan located in the warm channel, wherein the first and second fans are configured for moving air within their respective channels;

h) a control system for the air-to-air heat pump system, the control system including a processor configured for: receiving a signal from a freezing sensor indicating that the first heat pump coil has frozen, and based on the indication of the freezing sensor activating the air inlet valve so as to close the air inlet valve, and activating the first fan so as to decrease a speed of the first fan;

i) all of the foregoing provided in a monoblock or separate structure located inside a thermal circuit of the building or partially inside and partially outside a thermal circuit of the building.

2. The air-to-air heat pump system of claim 1, a wherein the cold channel is covered with a thermal insulation material.

3. The air-to-air heat pump system of claim 2, a wherein the cellular humidifier further comprises an evaporation pad and a tray in which water accumulates.

4. The air-to-air heat pump system of claim 3, wherein the humidifier's evaporation pad is made of cellulose paper.

5. The air-to-air heat pump system of claim 4, wherein the first and second heat pump coils are configured to absorb heat in the cold channel and disperse said heat in the warm channel.

6. The air-to-air heat pump system of claim 5, wherein the first fan located in the cool channel is configured to move air towards egress from the building via an exhaust.

7. The air-to-air heat pump system of claim 6, wherein the second fan located in the warm channel is configured to move air towards ingress into the building.

8. The air-to-air heat pump system of claim 7, further comprising an air filter located in the warm channel.

9. The air-to-air heat pump system of claim 8, further comprising an air inlet valve configured to supply or shut off the supply of external air entering into the cool channel.

10. The air-to-air heat pump system of claim 8, further comprising a backup electric heater located in the warm channel.

* * * * *